US007766098B2

(12) United States Patent
Farley

(10) Patent No.: US 7,766,098 B2
(45) Date of Patent: Aug. 3, 2010

(54) DIRECTIONAL DRILLING CONTROL USING MODULATED BIT ROTATION

(75) Inventor: Steven Reid Farley, Magnolia, TX (US)

(73) Assignee: Precision Energy Services, Inc., Fort Worth, TX (US)

( * ) Notice: Subject to any disclaimer, the term of this patent is extended or adjusted under 35 U.S.C. 154(b) by 273 days.

(21) Appl. No.: 11/848,328

(22) Filed: Aug. 31, 2007

(65) Prior Publication Data

US 2009/0057018 A1 Mar. 5, 2009

(51) Int. Cl.
*E21B 7/04* (2006.01)
*E21B 7/08* (2006.01)

(52) U.S. Cl. ..... 175/61; 175/62; 175/26

(58) Field of Classification Search ..... 175/26, 175/45, 61, 62, 103, 73
See application file for complete search history.

(56) References Cited

U.S. PATENT DOCUMENTS

| | | | |
|---|---|---|---|
| 3,481,420 | A | 12/1969 | Roll |
| 3,713,500 | A | 1/1973 | Russell |
| 4,465,147 | A | 8/1984 | Feenstra |
| 4,485,879 | A | 12/1984 | Kamp |
| 4,492,276 | A | 1/1985 | Kamp |
| 4,763,258 | A | 8/1988 | Engelder |
| 4,844,180 | A | 7/1989 | Zijsling |
| 4,862,568 | A | 9/1989 | Wankmuller |
| 4,880,066 | A | 11/1989 | Steiginga |
| 5,133,418 | A | 7/1992 | Gibson et al. |
| 2003/0146022 | A1 | 8/2003 | Krueger |
| 2004/0236553 | A1 | 11/2004 | Chen et al. |

FOREIGN PATENT DOCUMENTS

| | | |
|---|---|---|
| EP | 0171259 | 2/1986 |
| GB | 2352743 | 2/2001 |

OTHER PUBLICATIONS

International Search Report and Written Opinion from PCT/US2008/064642, dated Sep. 3, 2008.

*Primary Examiner*—William P Neuder
*Assistant Examiner*—Brad Harcourt
(74) *Attorney, Agent, or Firm*—Wong, Cabello, Lutsch, Rutherford & Brucculeri LLP

(57) ABSTRACT

A system for steering the direction of a borehole advanced by cutting action of a rotary drill bit by periodically varying the rotation speed of the drill bit. The steering system comprises a motor disposed in a bent housing subsection and operationally connected to a drill string and to the drill bit. The rotation speed of the drill bit is periodically varied by periodic varying the rotation speed of the motor or by periodic varying the rotation speed of the drill string. Periodic bit speed rotation results in preferential cutting of material from a predetermined arc of the borehole wall which, in turn, resulting in borehole deviation. Both the drill string and the drill motor are rotated simultaneously during straight and deviated borehole drilling.

8 Claims, 4 Drawing Sheets

DIRECTIONAL DRILLING CONTROL USING MODULATED BIT ROTATION

FIELD OF THE INVENTION

This invention is related to the directional drilling of a well borehole. More particularly, the invention is related to steering the direction of a borehole advanced by a rotary drill bit by periodically varying rotational speed of the drill bit during a revolution of the drill string to which the drill bit is operationally connected.

BACKGROUND

The complex trajectories and multi-target oil wells require precision placement of well borehole path and the flexibility to continually maintain path control. It is preferred to control or "steer" the direction or path of the borehole during the drilling operation. It is further preferred to control the path rapidly during the drilling operation at any depth and target as the borehole is advanced by the drilling operation.

Directional drilling is complicated by the necessity to operate a drill bit steering device within harsh borehole conditions. The steering device is typically disposed near the drill bit, which terminates a lower or "down hole" end of a drill string. In order to obtain the desired real time directional control, it is preferred to operate the steering device remotely from the surface of the earth. Furthermore, the steering device must be operated to maintain the desired path and direction while being deployed at possibly a great depth within the borehole and while maintaining practical drilling speeds. Finally, the steering device must reliably operate under exceptional heat, pressure, and vibration conditions that can be encountered during the drilling operation.

Many types of directional steering devices, comprising a motor disposed in a housing with an axis displaced from the axis of the drill string, are known in the prior art. The motor can be a variety of types including electric, or hydraulic. Hydraulic turbine motors operated by circulating drilling fluid are commonly known as a "mud" motors. A rotary bit is attached to a shaft of the motor, and is rotated by the action of the motor. The axially offset motor housing, commonly referred to as a bent subsection or "bent sub", provides axial displacement that can be used to change the trajectory of the borehole. By rotating the drill bit with the motor and simultaneously rotating the drill bit with the drill string, the trajectory or path of the advancing borehole is parallel to the axis of the drill string. By rotating the drill bit with the motor only, the trajectory of the borehole is deviated from the axis of the drill string. By alternating these two methodologies of drill bit rotation, the path of the borehole can be controlled. A more detailed description of directional drilling using the bent sub concept is presented in U.S. Pat. Nos. 3,713,500, 3,841,420 and 4,492,276, which are herein entered into this disclosure by reference.

The prior art contains methods and apparatus for adjusting the angle of "bend" of a bent sub housing thereby directing the angle of borehole deviation as a function of this angle. The prior art also contains apparatus and methods for dealing with unwanted torques that result from steering operations including clutches that control relative bit rotation in order to position the bit azimuthally as needed within the walls of the borehole. Prior art steering systems using variations of the bent sub concept typically rely upon complex pushing or pointing forces and the associated equipment which directs the hole path by exerting large pressures on the bit perpendicular to the borehole path while rotating the drill string.

These forces are often obtained using hydraulic systems that are typically expensive and present additional operational risks in the previously mentioned harsh drilling environment. Furthermore, these perpendicular forces typically require the steering device to be fabricated with mechanically strong components thereby further increasing the initial and operating cost of the steering device.

SUMMARY OF THE INVENTION

This invention comprises apparatus and methods for steering the direction of a borehole advanced by cutting action of a rotary drill bit terminating a lower or "down hole" end of a drill string. The rotation speed of the bit is periodically varied during a rotation of the drill string thereby cutting a disproportionately larger amount of material from an azimuthal arc of wall of the borehole, which will results in an azimuthal deviation in borehole direction.

The steering device, which is disposed at the downhole end of a drill string, comprises a motor disposed in a bent housing subsection or "bent sub". A rotary drill bit is attached to a shaft of the motor. The drill bit is rotated by both the motor and by the rotary action of the drill string.

As stated above, the steering system is designed so that the rotating drill bit disproportionally cuts material along the wall of the borehole in a predetermined azimuthal arc to direct the advancement of the borehole in a desired trajectory. In the disclosed examples of the invention, the rotation rate of the bit is periodically slowed in this predetermined arc cutting a disproportionally small amount of material from the borehole wall. As a result, the bit moves to the opposite side of the borehole and cuts disproportionately larger amount of material from the borehole wall. The borehole then tends to deviate and advance in the azimuthal direction in which the disproportional large amount of borehole wall material has been removed.

The removal of material from the wall of the borehole, thus the steering of the borehole trajectory, is accomplished by periodically varying the rotational speed of the drill bit during a rotation of the drill string. The steering system uses two elements for rotating the drill bit. The first element used to rotate the drill bit is the rotating drill string. The second element used to rotate the drill bit is the motor disposed within the bent sub and operationally connected to the drill bit. The final drill bit rotational speed is the sum of the rotational speeds provided by the drill string and the motor.

It is preferred that both the drill string and the motor rotate simultaneously. If a constant borehole trajectory is desired, both the drill string and motor rotation speeds are held constant throughout a drill string revolution. The procession of the bit rotation around the borehole removes essentially the same amount of material azimuthally around the borehole wall. If a deviated borehole trajectory is desired, the rotation speed of the drill bit is varied as it passes through a predetermined azimuthal sector of the borehole wall. This periodic variation in bit speed can be accomplished by periodically varying the rotational speed of the motor, or by periodically varying the rotational speed of the drill string. Both methodologies remove disproportionately small amounts from one side of the borehole and remove disproportionately larger amounts of material the opposite side of the borehole. The borehole is deviated in the direction of disproportionately large amount of material removal. Both methodologies will be discussed in detail in subsequent sections of this disclosure.

BRIEF DESCRIPTION OF THE DRAWINGS

The manner in which the above recited features and advantages, briefly summarized above, are obtained can be understood in detail by reference to the embodiments illustrated in the appended drawings.

DETAILED DESCRIPTION OF THE PREFERRED EMBODIMENTS

This invention comprises apparatus and methods for steering the direction of a borehole advanced by cutting action of a rotary drill bit. The invention will be disclosed in sections. The first section is directed toward hardware. The second section details basic operating principles of the invention. The third section details two embodiments of the invention that will produce the desired borehole steering results.

Directional drilling is obtained by periodically varying the rotation rate of the drill bit. For purposes of this disclosure "periodic variation" is defined as varying the drill bit rotation speed in a plurality of 360 degree drill string rotations or "cycles" at the same azimuthal arc in the plurality of rotations.

Hardware

Figure 1:
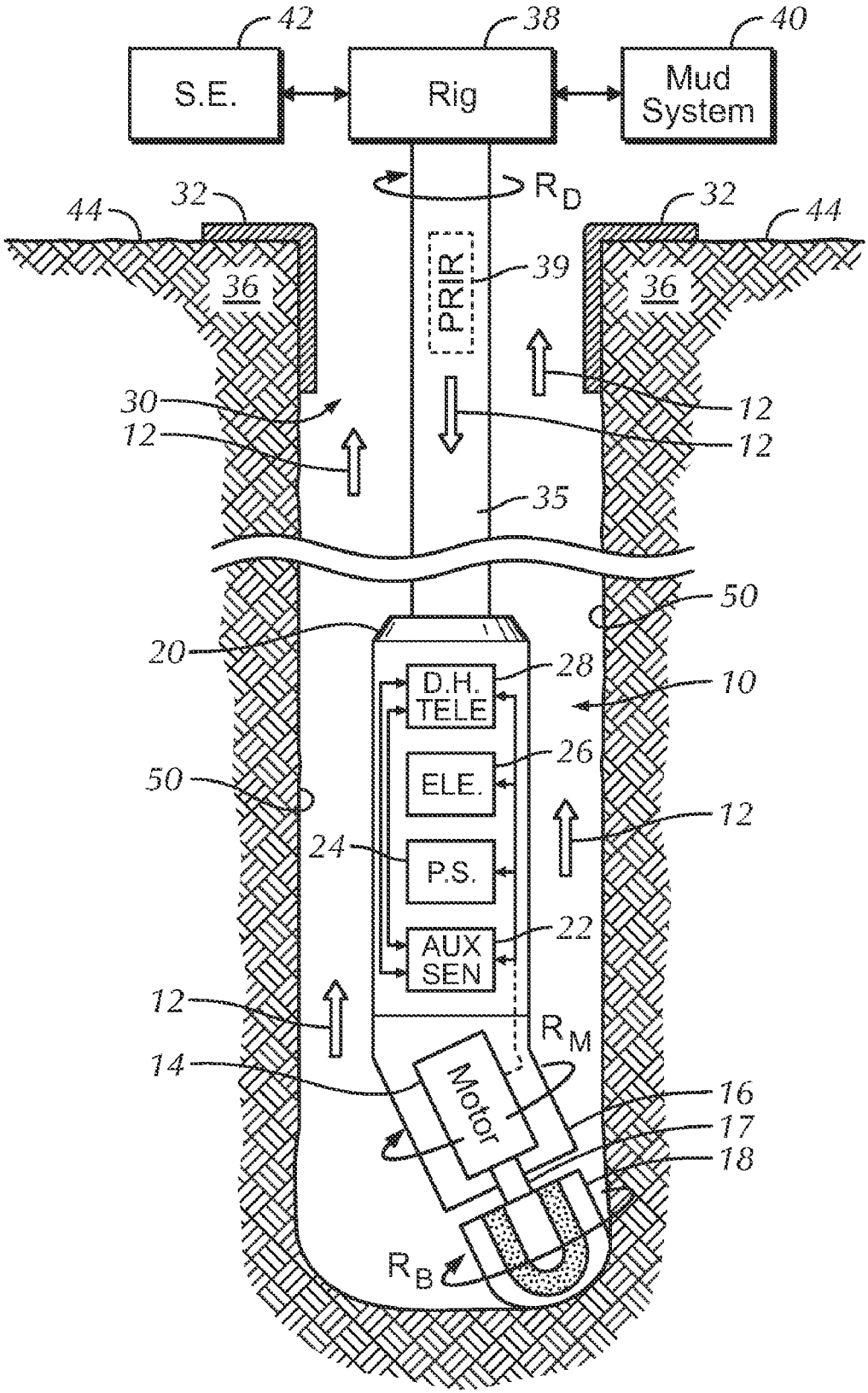
FIG. 1 illustrates borehole assembly comprising a bent sub and motor disposed in a well borehole by a drill string operationally attached to a rotary drilling rig.

Attention is directed to FIG. 1, which illustrates a borehole assembly (BHA) 10 suspended in a borehole 30 defined by a wall 50 and penetrating earth formation 36. The upper end of the BHA 10 is operationally connected to a lower end of a drill pipe 35 by means of a suitable connector 20. The upper end of the drill pipe 35 is operationally connected to a rotary drilling rig, which is well known in the art and represented conceptually at 38. Surface casing 32 extends from the borehole 30 to the surface 44 of the earth. Elements of the steering apparatus are disposed within the BHA 10. Motor 14 is disposed within a bent sub 16. The motor 14 can be electrical or a Monyo or turbine type motor. A rotary drill bit 18 is operationally connected to the motor 14 by a motor shaft 17, and is rotated as illustrated conceptually by the arrow $R_B$.

Again referring to FIG. 1, the BHA 10 also comprises an auxiliary sensor section 22, a power supply section 24, an electronics section 26, and a downhole telemetry section 28. The auxiliary sensor section 22 comprises directional sensors such as magnetometers and inclinometers that can be used to indicate the orientation of the BHA 10 within the borehole 30. This information, in turn, is used in defining the borehole trajectory path for the steering methodology. The auxiliary sensor section 22 can also comprise other sensors used in Measurement-While-Drilling (MWD) and Logging-While-Drilling (LWD) operations including, but not limited to, sensors responsive to gamma radiation, neutron radiation and electromagnetic fields. The electronics section 26 comprises electronic circuitry to operate and control other elements within the BHA 10. The electronics section 26 preferably comprise downhole memory (not shown) for storing directional drilling parameters, measurements made by the sensor section, and directional drilling operating systems. The electronic section 26 also preferably comprises a downhole processor to process various measurement and telemetry data. Elements within the BHA 10 are in communication with the surface 44 of the earth via a downhole telemetry section 28. The downhole telemetry section 28 receives and transmits data to an uphole telemetry section (not shown) preferably disposed within surface equipment 42. Various types of borehole telemetry systems are applicable including mud pulse systems, mud siren systems, electromagnetic systems and acoustic systems. A power supply section 24 supplies electrical power necessary to operate the other elements within the BHA 10. The power is typically supplied by batteries.

Once again referring to FIG. 1, drilling fluid or drilling "mud" is circulated from the surface 44 downward through the drill string comprising the drill pipe and BHA 10, exits through the drill bit 18, and returns to the surface via the borehole-drill string annulus. Circulation is illustrated conceptually by the arrows 12. The drilling fluid system is well known in the art and is represented conceptually at 40. If the motor 14 is a turbine or "mud" motor, the downward flow of drilling fluid imparts rotation to the drill bit 18 through the shaft 17, as indicated by the arrow $R_M$. For purposes of illustration in FIG. 1, it is assumed that the motor 14 is a mud motor. The steering system utilizes a periodic variation in the rotational speed of the drill bit 18 in defining trajectory of the advancing borehole 30. In one embodiment of the invention, the rotational speed of the drill bit 18 is periodically varied by periodically varying the rotation of the motor 14. Since in FIG. 1 it is assumed that the motor 14 is a mud motor, rotational speed is varied by varying drilling fluid flow through the mud motor. This is accomplished with a fluid flow restriction or fluid release element which can be disposed within the drill string (as shown conceptually at 39) or at the surface 44 within (not shown) the mud pump system 40. The fluid flow restriction or fluid release element is illustrated with broken lines since it is not needed if the motor 14 is electric. Although a mud motor is assumed from purposes of discussion, an electrical motor can also be used eliminating the need for the fluid flow restriction or fluid flow release element 39. Electric motor speed is controlled electrically by the cooperating electronics section 26 and power supply sections 24. The connection between the power supply section 24 and the motor 14 is shown as a broken line since the connection is not needed if the motor is of the turbine type.

Still referring to FIG. 1, the rotary rig 38 imparts an additional rotation component, indicated conceptually by the arrow $R_D$, to the rotary drill bit 18 by rotating the drill pipe 35 and BHA 10. Drill string rotation speed is typically controlled from the surface, using the surface equipment 42, based upon predetermined trajectory information or from BHA orientation information telemetered from sensors in the auxiliary sensor section 22. Motor rotation speed (indicated conceptually by the arrow $R_M$) is typically controlled by signals telemetered from the surface using BHA 10 position and orientation information measured by the auxiliary section 22 and telemetered to the surface. Alternately, motor rotational speed $R_M$ can be controlled using orientation information measured by the auxiliary sensor section cooperating with predetermined control information stored in a downhole processor within the electronics section 26.

Basic Operating Principles

The BHA 10 shown in FIG. 1, when rotated at a constant rotation speed within the borehole 30, sweeps a circular path drilling a borehole slightly larger than the diameter of the drill bit 18. This larger diameter, defined by the borehole wall 50, is due to the angle defined by the axis of the drill pipe 35 and the axis of the bent sub housing 16.

As discussed previously, two components of drill bit rotation are present. The first component results from the action of the drilling rig 38 that rotates the entire drill string at a rotation rate of $R_D$. The second component of rotation results from the action of the motor 10 that rotates the bit at a rate $R_M$. The rotation speed of the drill bit, $R_B$, is the sum of these two components. Stated mathematically, the rotation speed $R_B$ $$R_B=R_D+R_M \tag{1}$$

As shown above, the two components $R_D$ and $R_M$ comprising the final drill bit rotation speed $R_B$ are generally considered separable where directional control is required. As a prior art example, if $R_D$ is set to zero, then the motor 14 will continue to turn the drill bit 18 at a rotation speed $R_M$. The drill bit will increase borehole deviation angle at a constant azimuthal angle defined by the position of the non rotating bent sub 16, with the drill string sliding down the borehole behind the advancing drill bit. Alternately, if a constant trajectory hole is require to be drilled, then the drill string rotation $R_D$ is initiated along with motor rotation $R_M$, the azimuthal angle of the bent sub 16 is no longer constant due to the rotation of the BHA 10, and the drill bit rotating at $R_B=R_M+R_D$ cuts equally into all sides of hole.

In the periodic procession of the drill bit around the wall of the borehole described above, where $R_D$ and $R_M$ are not equal to zero, the drill bit 18 cuts a different azimuthal section of the hole as a function of procession time. It is during this periodic drill bit procession that $R_B$ can be instantaneously and periodically changed during each revolution of the BHA 10 to preferentially cut one side of the hole at a different rate than it cuts the opposite side of the hole. This also results in increasing borehole deviation angle, while still rotating the drill string. There are operational advantages to continue to rotate the drill string, as will be discussed in a subsequent section of this disclosure. The periodic change in $R_B$ per revolution of the drill string can be implemented by varying either $R_D$ or $R_M$, as will be discussed in detail in subsequent sections of this disclosure.

Figure 2:
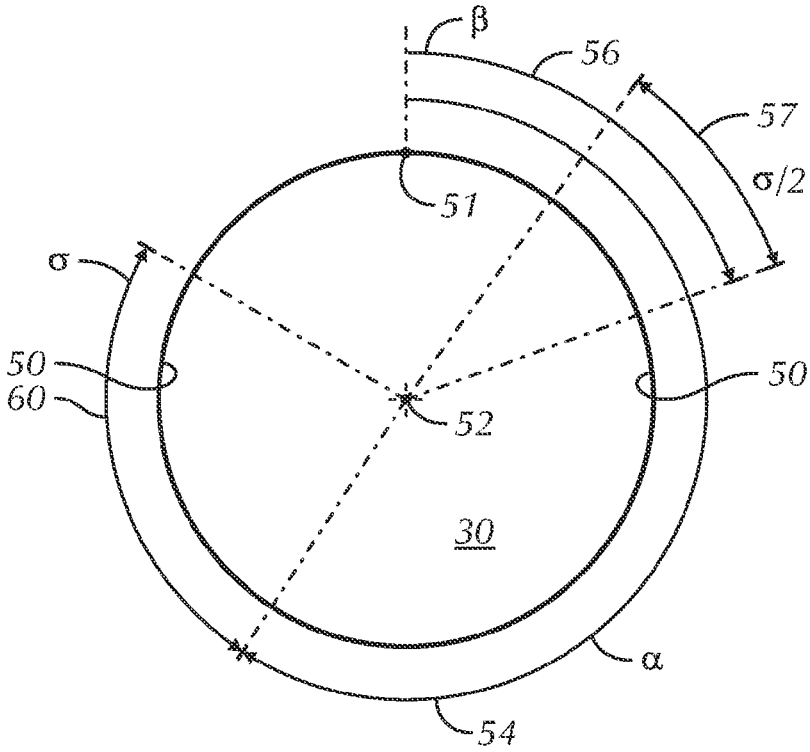
FIG. 2 is a cross section of a cylindrical borehole and is used to define certain parameters used in the steering methodology of the invention.

FIG. 2 is a cross section of a cylindrical borehole 30 and is used to define certain parameters used in the steering methodology. The center of the borehole is indicated at 52, and a borehole or "zero" azimuthal reference angle is indicated at 51. For purposes of discussion, assume that $R_D$ and $R_M$ are non zero, and during the procession of the drill bit within the borehole, the drill bit rotation speed $R_B=R_D+R_M$ is decreased to a value $R_{Bd}$ beginning essentially at speed variation angle $\alpha$ indicated at 54 and continued through a "dwell" angle of magnitude $\sigma$ indicated at 60. The azimuthal position of the variation angle $\alpha$ angle is preferably defined with respect to the reference angle 51. The bit rotation speed then resumes essentially to $R_B$ for the remainder of the 360 degree rotation cycle. The instantaneous and periodic change from $R_B$ to $R_{Bd}$ can be obtained by decreasing either $R_D$ or $R_M$ (or both), as will be discussed in subsequent sections of this disclosure. This decrease in cutting power during the dwell angle $\sigma$ (shown at 60) will leave a surplus of borehole wall material essentially at the azimuthal dwell angle $\sigma$. This surplus of material naturally causes the drill bit to move radially to the opposite side of the hole to an azimuthal arc section $\sigma/2$ is indicated at 57 that terminates at an angle $\beta$, where:

$$\beta=\alpha-180°+\sigma/2 \tag{2}$$

and $\beta$ is indicated at 56. Drill bit rotation speed through the arc $\sigma/2$ to the angle $\beta$ is $R_B$ or greater which is, of course, greater than $R_{Bd}$. This results in the removal of a disproportionally large amount of borehole wall material essentially in the azimuthal arc 57 thereby deviating the borehole in this azimuthal direction.

Figure 3:
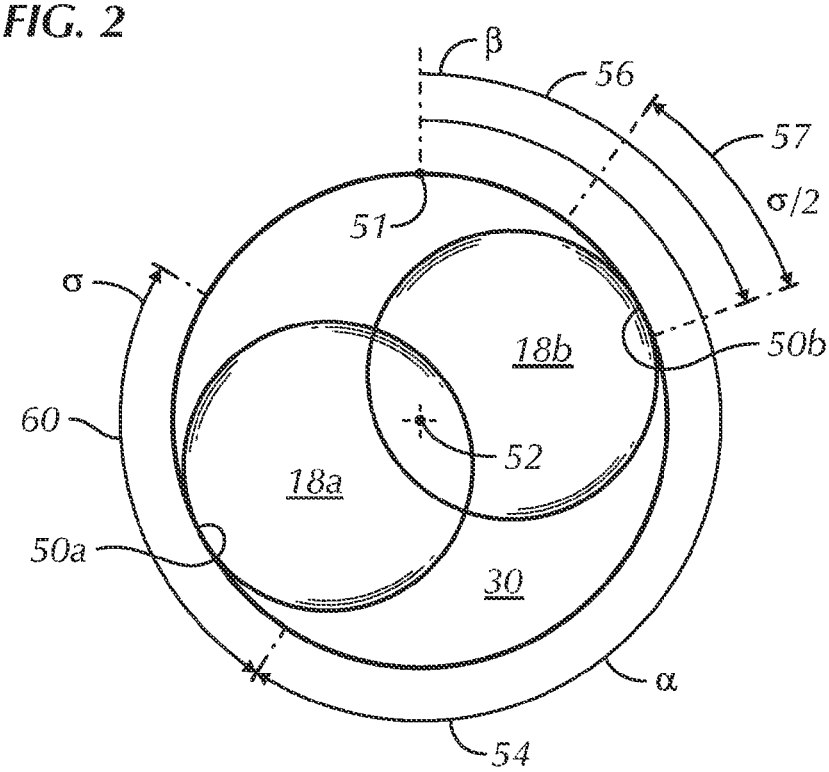
FIG. 3 is a cross section of a borehole in which the rotation speed of the borehole has been varied thereby removing a disproportionately small amount of material from one side of the borehole and a disproportionately large amount of material from the opposite side of the borehole.

The previously discussed effects of varying the drill bit rotation speed are illustrated conceptually in the borehole cross sectional view of FIG. 3. Drill bit rotation speed is reduced from $R_B$ to $R_{Bd}$ when the bit reaches angle $\alpha$ denoted at 54. The drill bit in this azimuthal position is depicted as 18*a*. Because of the reduction in bit rotation speed, there is an excess of material along the borehole wall at 50*a*, which corresponds to the dwell angle $\sigma$ shown in FIG. 2. Drill bit rotational speed is subsequently increased to $R_B$, and the bit moves to the opposite side of the borehole 30 to the azimuthal arc 57 terminating at angle $\beta$. The drill bit in this position is as depicted conceptually at 18*b*. With the drill bit rotating at $R_B$ or faster (due to lack of resistance in moving across the borehole), a disproportionally large amount of borehole wall is removed at 50*b*. By periodically reducing the rotation speed of the bit at the speed variation angle $\alpha$ as the BHA rotates within the borehole 30, the angle of borehole deviation continues to build in the azimuthal region defined by the arc 57 and the angle $\beta$.

It should be understood that borehole deviation can also be obtained by periodically increasing $R_B$ thereby removing a disproportional amount of borehole wall at the angle of periodic rotation increase.

Techniques for Periodically Varying Bit Rotation Speed

Equation (1) illustrates mathematically that drill bit rotation speed $R_B$ can be varied by varying either the motor rotation speed $R_M$ or the drill string rotation speed $R_D$.

Figure 4A:
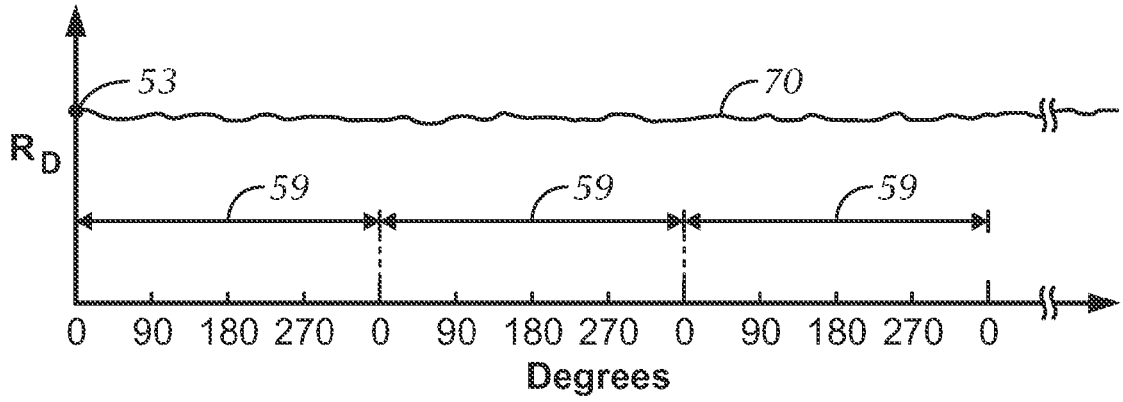
FIG. 4*a* is a plot of a constant rate of rotation of the drill string as a function of a plurality of rotational cycles.
Figure 4B:
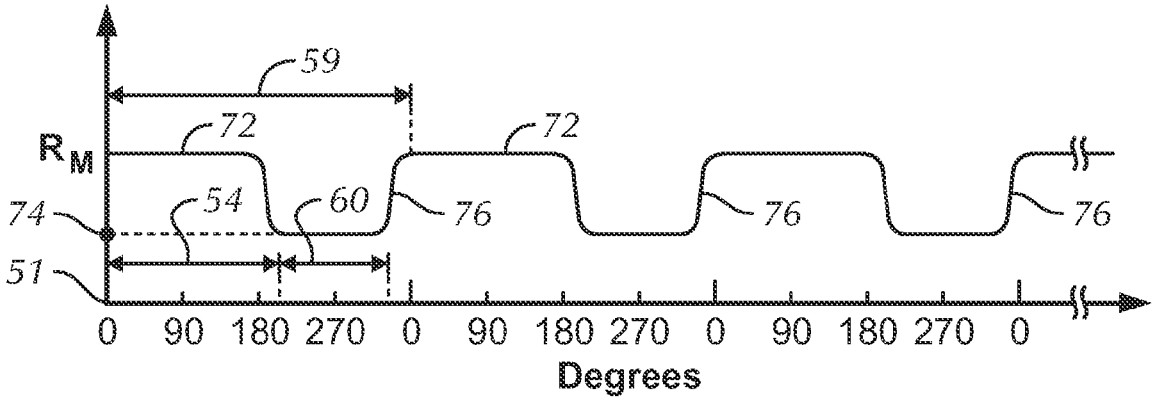
FIG. 4*b* is a plot of a periodic decreasing rotation rate of the motor as a function of a plurality of drill string rotations.
Figure 4C:
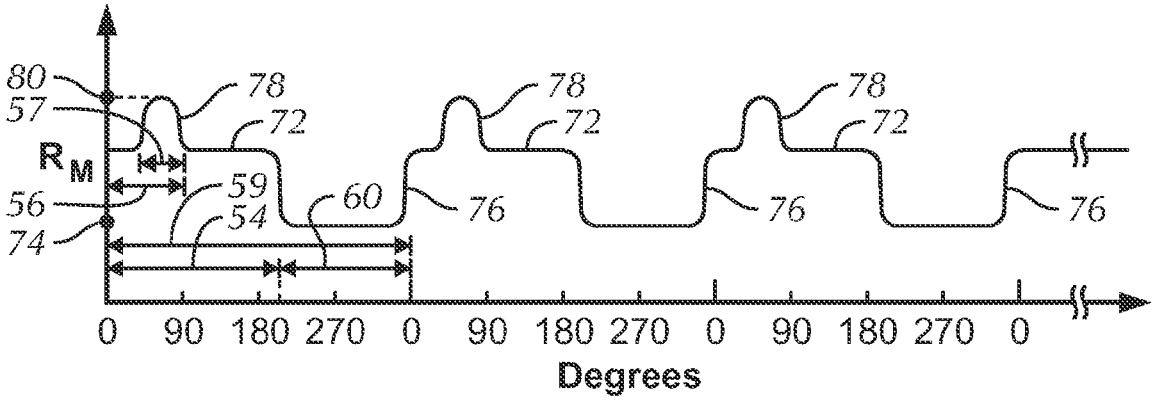
FIG. 4*c* is a plot of a periodic decreasing and periodic increasing rotation rate of the motor as a function of a plurality of drill string rotation cycles.

FIGS. 4*a*, 4*b* and 4*c* illustrate graphically methodology for periodically varying $R_B$ by periodically varying $R_M$ and holding $R_D$ at a constant.

Curve 70 in FIG. 4*a* represents $R_D$ as a function of angle through which the BHA 10 is rotated. Expanding on the examples discussed above and illustrated in FIGS. 2 and 3, the reference or "zero" angle is again denoted at 51. A complete 360 degree BHA rotation cycle is represented at 59, with three such cycles being illustrated. The drill string is, therefore, rotating at a constant speed $R_D$ shown at 53.

With the drill string rotating at a constant value of 53, curve 72 in FIG. 4*b* represents drill bit rotation speed $R_M$ as a function of angle through which the BHA 10 is rotated. As in FIG. 4*a*, the reference angle for a drill string rotation cycle is denoted at 51, with three cycles 59 again being depicted. Further expanding on the examples discussed above and illustrated in FIGS. 2 and 3, $R_M$ is periodically decreased, as indicated by excursions 76, to a value at 74 beginning at an angle 54 (which corresponds to the speed variation angle $\alpha$) for a dwell angle of 60 (which corresponds to the dwell angle of magnitude σ). This variation in $R_M$ is repeated periodically during rotation cycles of the drill string.

As discussed previously, a decrease in bit rotation on one side of the borehole causes the drill bit to move to the opposite side of the borehole where bit rotation speed returns to normal or even increases. FIG. 4*c* is an illustration similar to FIG. 4*b*, but illustrates a periodic decrease and increase in $R_M$. The excursions 76 again illustrate a decrease in $R_M$ to a value 74 at azimuthal angle 54 (corresponding to the angle α). In addition, the excursions 78 illustrate an increase in the value of $R_M$ to 80 at azimuthal arc 57 terminating at angle 56 (corresponding to the angle β).

Considering illustrations shown In FIGS. 4*a*, 4*b* and 4*c*, it can be seen that when $R_D$ is held constant and $R_M$ is varied periodically, the rotation speed or the drill bit $R_B=R_D+R_M$ is varied periodically thereby resulting in the desired borehole deviation.

The periodic variation in $R_M$ can be controlled in real time while drilling using various techniques. Attention is again directed to FIG. 1 as well as FIGS. 4*a*, 4*b* and 4*c*. These real time steering methods typically utilize BHA 10 orientation and position measured with sensors within the auxiliary sensor section 22. A first method comprises the storing of a plurality of drill bit rotation speed variation responses (as a function of α and σ) within downhole memory in the electronics section 26. An appropriate sequence is then selected by a signal telemetered from the surface based upon BHA orientation telemetered to the surface along with the known borehole target. The appropriate sequence is typically determined using a surface processor within the surface equipment 42. This method is similar to the "look-up table" concept used in numerous electronics systems. A second method comprises telemetering values of α and σ from the surface equipment 42 to the BHA 10 to direct the drilling to the target. The values of α and σ are again selected by considering both BHA orientation data (measured with sensors disposed in the auxiliary sensor section 22) telemetered to the surface and the directional drilling target. Telemetered values of speed variation and dwell angles αand σ, respectively, are input into an operating program preferably resident in a downhole processor within the electronics section 26. Output supplied by the downhole processor is then used to control and periodically vary the rotation speed of the motor 14 to direct the borehole 30 to a desired formation target. Stated summarily, periodic varying rotation speed of said drill bit is defined by combining, within said downhole processor, responses of the auxiliary sensors with rotation information telemetered from said surface of the earth.

It should be understood that other techniques can be used to obtain periodic variations in $R_M$ including, but not limited to, the use of preprogrammed variation instructions stored in downhole memory of the electronics section 26 and combined with measured BHA orientation data using sensors in the auxiliary sensor section 22. This method requires no real time telemetry communication with the surface equipment 42.

Figure 5A:
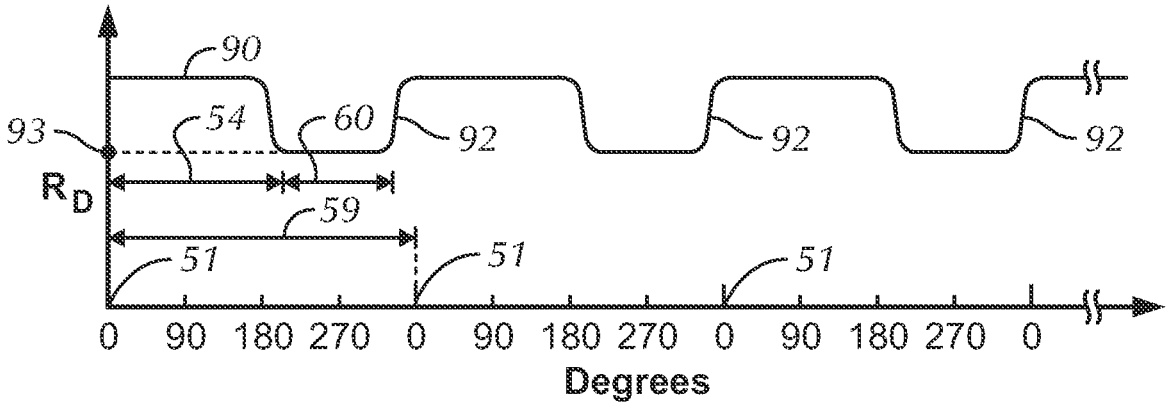
FIG. 5*a* is a plot of a periodic decreasing rotation rate of the drill string as a function of a plurality of drill string rotations.
Figure 5B:
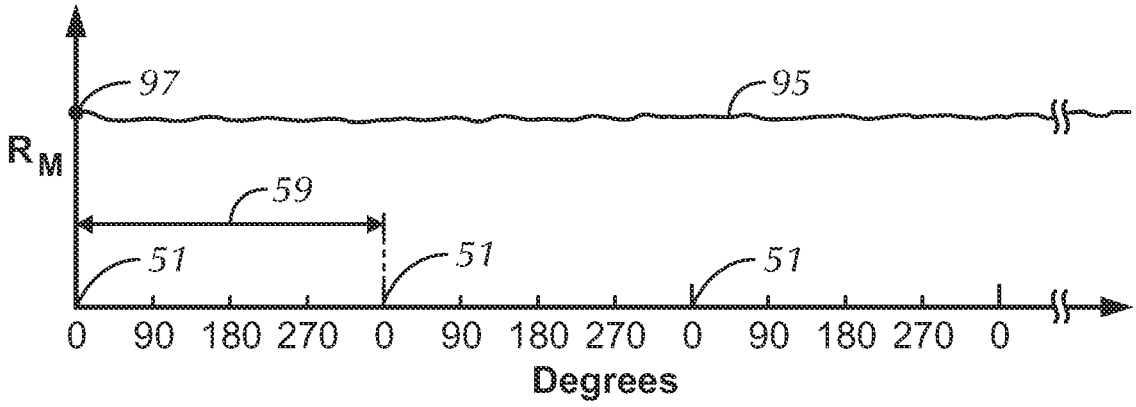
FIG. 5*b* is a plot of a constant rate of rotation of the motor as a function of a plurality of rotational cycles.

The rotation speed of the bit $R_B$ can also be varied by varying $R_D$, the rotation speed of the drill string. Attention is directed to FIGS. 5*a* and 5*b*. Curve 95 of FIG. 5*b* shows the motor 14 rotating at a constant speed $R_M$ 97 as a function of angle through which the BHA 10 is rotated. As in FIGS. 4*a*, 4*b* and 4*c*, the reference angle for a drill string rotation cycle is denoted at 51, with three drill string rotation cycles 59 again being depicted. FIG. 5*a* shows the rotation speed $R_D$ of the drill string being periodically varied. Using again the previously discussed example, the first rotation $R_D$ is periodically decreased, as indicated by the excursions 92, to a second rotation speed at 93 beginning at a speed variation angle 54 (which corresponds to the angle α) for a dwell angle of 60 (which corresponds to the angle σ). This variation in $R_D$ between the first and second rotation speeds is repeated periodically during rotation cycles of the drill string.

Considering illustrations shown In FIGS. 5*a* and 5*b*, it can bee seen that when $R_M$ is held constant and $R_D$ is varied periodically, the rotation speed or the drill bit $R_B=R_D+R_M$ is varied periodically thereby resulting in the desired borehole deviation.

The periodic variation in $R_B$ is typically controlled at the surface of the earth using the surface equipment 42 (into which values of α and σ are input) cooperating with the rotary table (not shown) of the drilling rig 38.

It should be understood that the rate at which a borehole deviation angle is built depends upon a number of factors including the magnitude of increase or decrease of the periodic variation of the rotation speed of the drill bit. For a given variation of drill bit rotation speed, the value of $R_B$ can be varied at periodically staggered drill string rotation cycles, such as every other rotation, every third rotation, every fourth rotation, and the like. It should also be understood that $R_B$ can be varied by periodically and synchronously varying both $R_D$ and $R_M$ using techniques disclosed above.

In an alternate embodiment of the invention, two telemetry systems are used. A first system is dedicated controlling the periodic variation of the drill bit rotation speed $R_B$. A second telemetry system is dedicated to telemetering measurements made by sensors disposed within the auxiliary sensor section 22 of the BHA 10.

SUMMARY

This invention comprises apparatus and methods for steering the direction of a borehole advanced by cutting action of a rotary drill bit. Steering is accomplished by periodically varying, during a 360 degree rotation cycle of the drill string, the rotation speed of the drill bit thereby preferentially cutting differing amounts of material from the wall of the borehole within predetermined azimuthal arcs. The borehole deviates in an azimuthal direction in which a proportionally large amount of borehole wall has been cut. The drill bit is rotated by simultaneously rotating both the drill bit motor and the drill string. The invention requires little if any forces perpendicular to the axis of the borehole. Deviation is instead achieved by relying only on variation in rotation speed of the bit to preferentially remove material from the borehole wall while simultaneously maintaining drills string rotation. This allows the borehole path objectives to be achieved using lower strength, less expensive materials that are required in other such methods and associated devices. Furthermore, the invention does not require the use of hydraulics to push drill string members into the desired direction of deviation. Continuous rotation of the drill string, while drilling both straight and deviated borehole, provides superior heat dissipation and more torque at the drill bit.

The above disclosure is to be regarded as illustrative and not restrictive, and the invention is limited only by the claims that follow.

What is claimed is:

1. A method for deviating a borehole advanced by a rotating drill bit, the method comprising:

periodically varying rotation speed of said drill bit to preferentially remove a disproportional amount of material in an azimuthal arc of a wall of said borehole;

periodically varying, at a speed variation angle, said rotation speed of said drill bit from a first rotation speed to a second rotation speed;

maintaining said second rotation speed through a dwell angle; and subsequently resuming said first rotation speed.

2. The method of claim 1 further comprising varying rotation of said drill bit by periodic varying rotation speed of a drill bit motor to which said drill bit is operationally attached.

3. The method of claim 1 further comprising periodic varying rotation speed of said drill bit by periodic varying rotation rate of a drill string to which said drill bit is operationally attached.

4. The method of claim 1 wherein:

said drill bit is operationally attached to a drill bit motor and to a drill string; and said drill bit motor and said drill string are simultaneously rotated while rotation speed of said drill bit is periodically varied.

5. The method of claim 1 further comprising telemetering, from the surface of the earth, said speed variation angle and said dwell angle to downhole processor cooperating with said drill bit motor thereby periodic varying said rotation speed of said drill bit by controlling said rotation speed of said drill bit motor.

6. The method of claim 1 further comprising:

storing said speed variation angle and said dwell angle in a downhole memory; and transferring said speed variation angle and said dwell angle to downhole processor cooperating with said drill bit motor thereby periodic varying said rotation speed of said drill bit by controlling said rotation speed of said drill motor.

7. The method of claim 1 further comprising telemetering, from the surface of the earth, said speed variation angle and said dwell angle to a downhole processor cooperating with a drill bit motor thereby periodically varying said rotation speed of said drill bit by controlling said rotation speed of said drill bit motor.

8. The method of claim 1 further comprising:

storing said speed variation angle and said dwell angle in a downhole memory; and transferring said speed variation angle and said dwell angle to a downhole processor cooperating with said drill motor thereby periodically varying said rotation speed of said drill bit by controlling rotation speed of said drill motor.

* * * * *